US009887479B2

(12) United States Patent
Mukuno et al.

(10) Patent No.: US 9,887,479 B2
(45) Date of Patent: Feb. 6, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Junichi Mukuno, Mie (JP); Katsuhiko Aizawa, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD, Osaka-shi, Osaka (JP)

( * ) Notice: Subject to any disclaimer, the term of this patent is extended or adjusted under 35 U.S.C. 154(b) by 0 days.

(21) Appl. No.: 15/309,818

(22) PCT Filed: May 18, 2015

(86) PCT No.: PCT/JP2015/064149
§ 371 (c)(1),
(2) Date: Nov. 9, 2016

(87) PCT Pub. No.: WO2015/186497
PCT Pub. Date: Dec. 10, 2015

(65) Prior Publication Data

US 2017/0149159 A1 May 25, 2017

(30) Foreign Application Priority Data

Jun. 4, 2014 (JP) ..... 2014-115534

(51) Int. Cl.
*H01R 13/24* (2006.01)
*H01R 13/621* (2006.01)
*H01R 13/52* (2006.01)

(52) U.S. Cl.
CPC ..... *H01R 13/2428* (2013.01); *H01R 13/2492* (2013.01); *H01R 13/5219* (2013.01); *H01R 13/6215* (2013.01)

(58) Field of Classification Search
CPC .. H01R 12/714; H01R 12/716; H01R 12/725; H01R 12/7076; H01R 24/60;
(Continued)

(56) References Cited

U.S. PATENT DOCUMENTS 4,640,562 A * 2/1987 Shoemaker ..... H01R 12/774 439/327
4,664,458 A * 5/1987 Worth ..... H01R 12/52 174/138 D
(Continued)

FOREIGN PATENT DOCUMENTS

JP 2-39483 3/1990
JP 7-18367 3/1995
(Continued)

OTHER PUBLICATIONS

International Search Report dated Aug. 11, 2015.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A shield connector (10) includes a housing (20) with a spring accommodating portion (25) open on a facing surface (24), a fixing plate (50) to be fixed to the housing (20) and mounted on a case wall (71), and springs (60) to be arranged inside the spring accommodating portion (25). Each spring
(Continued)

(60) includes a first support (63) and a second support (64) to be supported on the housing (20) and a resilient deformation portion (61) convexly curved toward the facing surface (24) and having a convex tip serving as a contact (62) projecting out from an opening of the housing (20) and to be brought into contact with the device-side terminal (73). The resilient deformation portion (61) includes slits (65) extending from a side connected to one of the first and second supports (63, 64) toward an opposite side across the contact portion (62).

6 Claims, 4 Drawing Sheets

(58) Field of Classification Search
CPC ..... H01R 13/245; H01R 13/2442; H01R 13/2464; H01R 13/2407; H01R 13/648
See application file for complete search history.

(56) References Cited

U.S. PATENT DOCUMENTS 5,259,769 A * 11/1993 Cruise ..... H01R 13/2442 439/65
5,464,355 A * 11/1995 Rothenberger .... H01R 13/5202 439/559
6,022,224 A 2/2000 Peters
6,454,572 B1 * 9/2002 Konetski ..... H01R 13/2435 361/784
6,524,140 B2 * 2/2003 Takagi ..... H01R 13/2428 439/700
7,261,579 B2 * 8/2007 Ku ..... H01R 12/716 439/289
7,273,390 B2 * 9/2007 Iida ..... H01R 43/16 439/357
9,413,087 B2 * 8/2016 Shariff ..... H01R 24/20
9,548,559 B2 * 1/2017 Zhou ..... H01R 13/6205

FOREIGN PATENT DOCUMENTS

JP 8-22871 1/1996
JP 2000-48884 2/2000
JP 2003-115357 4/2003
JP 2006-164682 6/2006
JP 2007-188675 7/2007
JP 2009-70656 4/2009
JP 2009-272132 11/2009

* cited by examiner

CONNECTOR

BACKGROUND

1. Field of the Invention

The present invention relates to a connector.

2. Description of the Related Art

Conventionally, some of connectors for connecting a wire to a device, such as a motor or an inverter mounted in an electric vehicle or a hybrid vehicle, have been structured such that an end part of the wire is held by a housing, the housing is fixed to a case of the device and a wire-side terminal fixed to an end of the wire is connected to a device-side terminal in the case. As an example of a connecting structure of the wire-side terminal and the device-side terminal, the wire-side terminal is placed on the device-side terminal and both terminals are fixed by bolting (see, for example, Japanese Unexamined Patent Publication No. 2009-272132).

In the configuration described above, it is necessary to ensure a space for arranging a bolt and a space for performing a bolt tightening operation. Thus, the connector tends to be large. Further, since the number of components increases and a production process is complicated, cost tends to increase.

The present invention was completed based on the above situation and aims to provide a connector capable of miniaturization and reducing production cost.

SUMMARY

The present invention is directed to a connector to be mounted on a device case with a case wall and a device-side terminal provided inside, the connector including a connector housing having an opening surface and including a spring accommodating portion open on the opening surface, a fixing plate to be fixed to the connector housing and mounted on the case wall, and at least one spring to be arranged inside the spring accommodating portion. The at least one spring includes at least one support to be supported on the connector housing and a resilient deformation portion convexly curved toward the opening surface and having a convex tip serving as a contact to be brought into contact with the device-side terminal. The resilient deformation portion includes a slit extending from a side connected to the support toward an opposite side across the contact.

According to the above configuration, the spring has a spring property and resiliently contacts the device-side terminal while being deflected in a direction toward the support from the contact by the device-side terminal as a mating member being pressed against the contact. Thus, if the device-side terminal is arranged at such a position that the spring is pressed thereagainst with the connector mounted on the device case, the spring can be connected to the device-side terminal by the spring property thereof. Particularly, by providing the spring with the slit, it is possible to reduce the rigidity of the resilient deformation portion and give a sufficient spring property to the spring to ensure connection to the device-side terminal.

The above-described connector eliminates the need for a bolt for connecting a terminal of the connector and the device-side terminal and also a bolt tightening operation. Further, a space for arranging the bolt and a space for performing the bolt tightening operation are also unnecessary. In this way, the connector can be miniaturized and a cost reduction due to a reduction in the number of components and a reduction in the number of operation steps is possible.

The following mode is preferable as an embodiment of the present invention.

The connector may include a fixing member for fixing the fixing plate while pressing the fixing plate toward the case wall. Accordingly, the spring is pressed toward the device-side terminal as the fixing plate is pressed toward the case wall and fixed by the fixing member. That is, since a direction in which the fixing plate is pressed against the device case by the bolt and a direction in which the spring is pressed toward the device-side terminal are the same when the connector is mounted, the spring and the device-side terminal can be brought resiliently into contact and connected by an operation of mounting the connector on the device case. In this way, a production process can be simplified further and cost can be reduced.

According to the present invention, it is possible to provide a connector capable of miniaturization and reducing production cost.

DETAILED DESCRIPTION

An embodiment of the present invention is described with reference to FIGS. 1 to 4. A connector of this embodiment is a shield connector 10 mounted in a vehicle such as an electric vehicle or a hybrid vehicle and to be mounted on a device case 70 for accommodating a device such as an inverter.

[Device Case 70]

Figure 4:
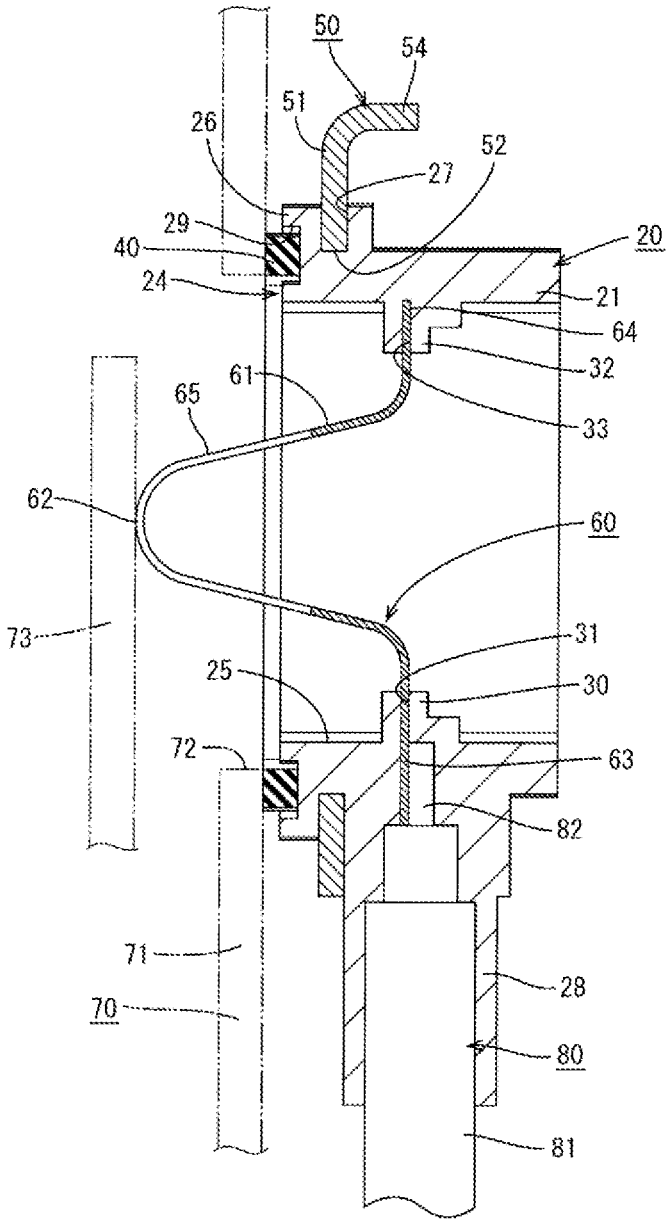
FIG. 4 is a section along A-A of FIG. 2.

A device case 70 is a metal box having an electromagnetic shielding function and includes a case wall 71 partitioning an internal space accommodating the device and an external space as shown in FIG. 4. The case wall 71 includes a mounting hole 72. The mounting hole 72 is a through hole penetrating from a wall surface of the case wall 71 facing the inside of the case and a wall surface facing the outside of the case. A plurality of device-side terminals 73 connected to the device are arranged in the device case 70. Each device-side terminal 73 is arranged at a position retracted more inwardly of the device case 70 than an arrangement position of the mounting hole 72.

[Terminal-Provided Wire 80]

As shown in FIG. 4, a terminal-provided wire 80 includes a wire 81 and a wire-side terminal 82. Although not shown in detail, the wire 81 has a general configuration including a core and an insulation coating covering the outer periphery of the core. The wire-side terminal 82 is connected to an end of the wire 81. The wire-side terminal 82 is made of metal and one end part thereof is crimped to the core exposed from an end of the insulation coating.

[Shield Connector 10]

Figure 1:
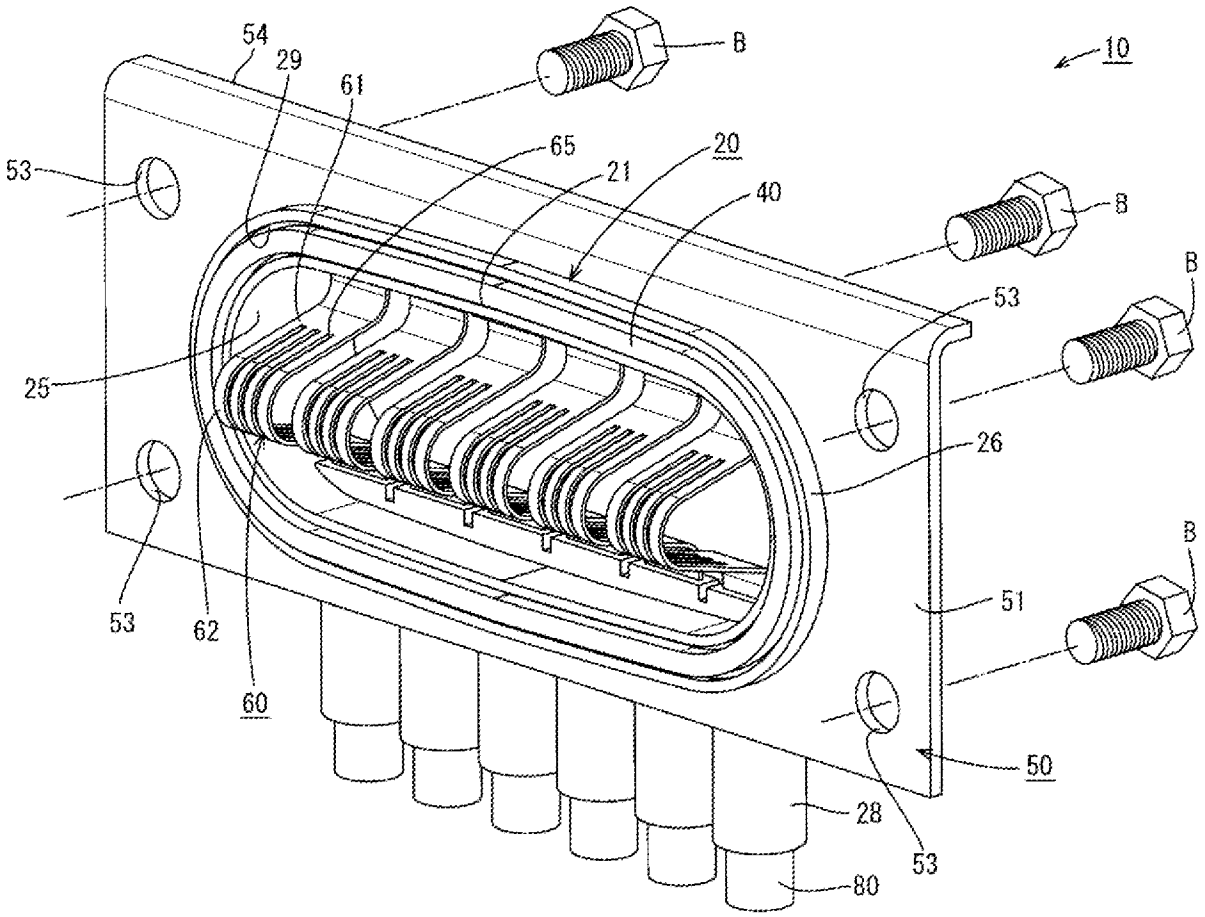
FIG. 1 is a perspective view of a connector of an embodiment.

The shield connector 10 is to be mounted on the device case 70. As shown in FIG. 1, the shield connector 10 includes a connector housing 20 (hereinafter, abbreviated as a "housing 20"), a seal 40, a fixing plate 50 and a plurality of springs 60. The housing 20 holds the springs 60 and the terminal-provided wires 80. The seal 40 is mounted in the housing 20 to seal between the housing 20 and the case wall 71. The fixing plate 50 is fixed to the housing 20 and mounted on the device case 70 by bolts B (corresponding to a fixing member). The spring 60 is connected to the terminal-provided wire 80 and is to be connected electrically conductively to the device-side terminal 73 with the shield connector 10 mounted on the device case 70.

(Housing 20)

The housing 20 is made of synthetic resin and includes a receptacle 21 in which the springs 60 are to be arranged, a plate holding portion 26 for holding the fixing plate 50, wire holding portions 26 for holding each of the terminal-provided wires 80, and first spring holding portions 30 and second spring holding portions 32 for holding the spring s 60.

Figure 2:
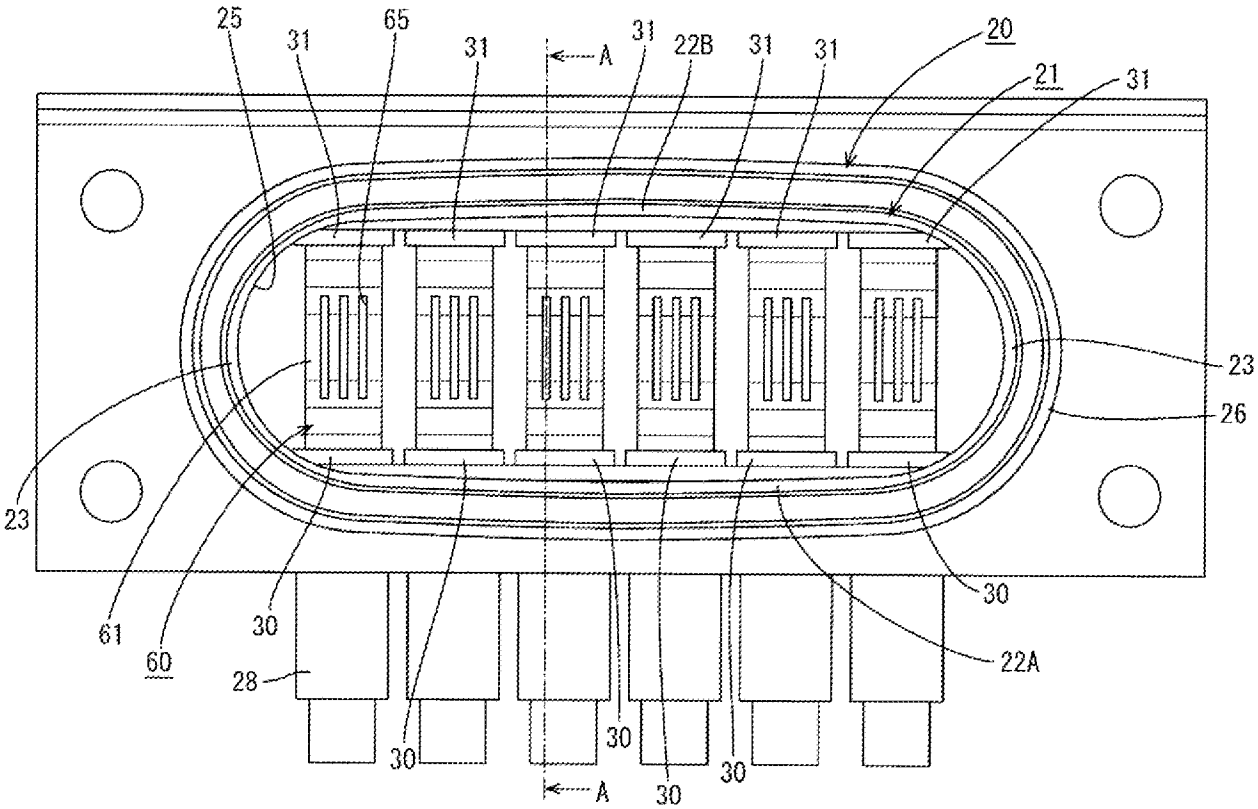
FIG. 2 is a front view of the connector of the embodiment.
Figure 3:
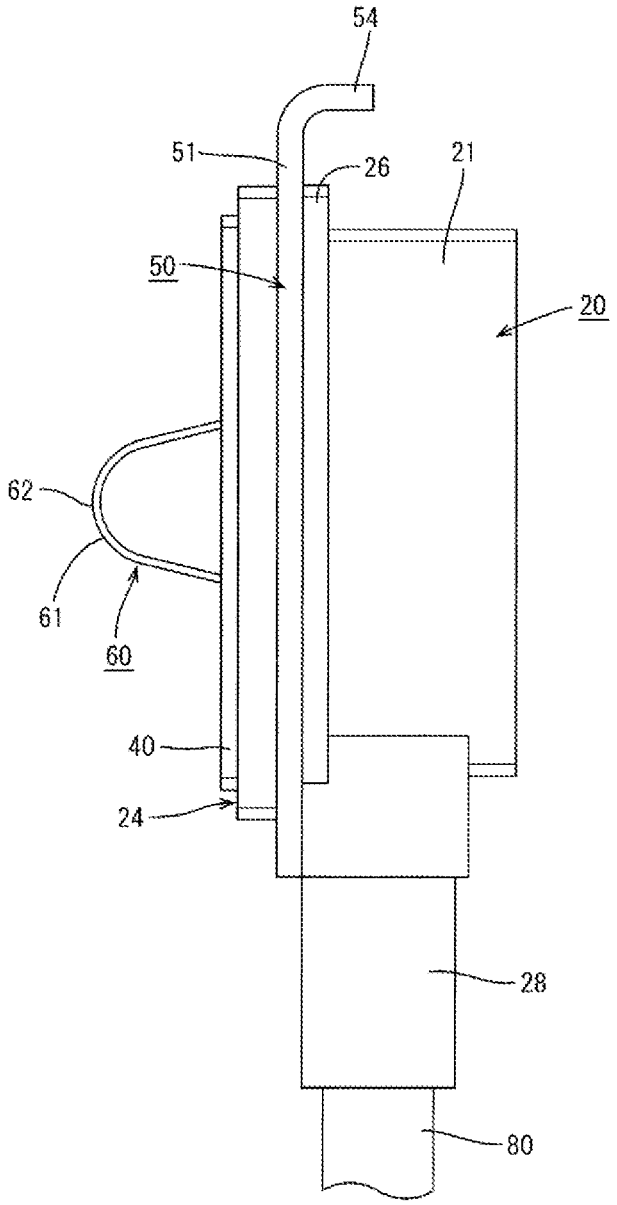
FIG. 3 is a side view of the connector of the embodiment.

The receptacle 21 is a tubular part open on both ends and, as shown in FIGS. 1 and 2, has a long and narrow rectangular cross-section with rounded corners and includes two long walls 22A, 22B arranged substantially parallel to each other and two short walls 23 respectively connecting end edges of the two long walls 22A, 22B. As shown in FIG. 4, the receptacle 21 is oriented such that a tube axis direction is perpendicular to the case wall 71. One opening surface of the receptacle 21 is a facing surface 24 facing the case wall 71 and arranged in parallel to the case wall 71. An internal space of the receptacle 21 serves as a spring accommodating portion 25 for accommodating the springs 60.

The plate holding portion 26 is a rib-like part projecting out from the outer peripheral surface of the receptacle 21. The plate holding portion 26 is arranged over the entire outer peripheral surface of the receptacle 21, as shown in FIG. 1, and is located on an end part on the side of the facing surface 24 of the receptacle 21, as shown in FIG. 4. The plate holding portion 26 includes a plate holding groove 27. As shown in FIG. 4, the plate holding groove 27 is recessed inwardly with the outer peripheral surface of the plate holding portion 26 as a reference (toward a tube center), and is arranged over the entire periphery of the plate holding portion 26.

As shown in FIG. 4, each of the wire holding portions 28 is a cylindrical part extending out perpendicularly from the long wall 22A. The wire holding portions 28 are arranged side by side along a circumferential direction of the receptacle 21 on one 22A of the two long walls 22A, 22B as shown in FIGS. 1 and 2 and are located at a side of the facing surface 24 opposite to the plate holding portion 26, as shown in FIG. 4. An end part of each wire 81 and the wire-side terminal 82 are arranged inside each wire holding portion 28.

Each of the first spring holding portions 30 and the second spring holding portions 32 is a rib-like part projecting into the spring accommodating portion 25 (toward the tube center) of the inner peripheral surface of the receptacle 21 as shown in FIG. 4. The first spring holding portions 30 are arranged side by side along the circumferential direction of the receptacle 21 on the one long wall 22A of the receptacle 21, and the second spring holding portions 32 are arranged side by side along the circumferential direction of the receptacle 21 on the other long wall 22B. Each pair of one first spring holding portion 30 and one second spring holding portion 32 are arranged to face each other as shown in FIG. 2.

As shown in FIG. 4, each first spring holding portion 30 includes a spring holding hole 31. The spring holding hole 31 penetrates from an inner side surface of the first spring holding portion 30 (surface parallel to the inner peripheral surface of the receptacle 21) to the outer peripheral surface of the receptacle 21 and communicates with an internal space of the wire holding portion 28.

As shown in FIG. 4, each second spring holding portion 32 includes a spring holding hole 33. The spring holding hole 33 is a groove recessed outwardly (toward the outer peripheral surface of the receptacle 21) with an inner side surface of the second spring holding portion 32 (surface parallel to the inner peripheral surface of the receptacle 21) as a reference.

The receptacle 21 includes a mounting groove 29 for mounting the seal 40. As shown in FIG. 4, the mounting hole 29 is recessed toward the other end surface of the receptacle 21 with the facing surface 24 as a reference, and is arranged over the entire periphery of the facing surface 24.

(Seal 40)

The seal 40 is a member formed of an elastic material such as rubber and is a long and narrow rectangular ring with rounded corners as shown in FIGS. 1 and 2. The seal 40 is arranged in the mounting groove 29. A thickness of the seal 40 is larger than a depth of the mounting groove 29 as shown in FIG. 4, and the seal 40 is arranged such that a part thereof slightly protrudes toward the case wall 71 from the mounting groove 29. The seal 40 functions to seal between the housing 20 and the case wall 71 by being sandwiched between the housing 20 and the case wall 71 when the shield connector 10 is mounted on the device case 70.

(Fixing Plate 50)

The fixing plate 50 is made of metal and is rectangular as a whole, as shown in FIGS. 1 and 2. A metal, such as aluminum, aluminum alloy, copper, copper alloy, iron or stainless steel, can be selected appropriately as the metal plate material constituting the fixing plate 50 according to need.

As shown in FIGS. 1 and 4, the fixing plate 50 includes a main plate 51, a receptacle mounting hole 52, four bolt insertion holes 53 and a reinforcing wall 54. The main plate 51 is a rectangular metal plate as a whole and has two long sides and two short sides respectively coupling the two long sides. The receptacle mounting hole 52 is a through hole with a substantially elliptical hole edge penetrating from one plate surface to the other plate surface of the main plate 51. The four bolt insertion holes 53 receive the bolts B for fixing the shield connector 10 to the device case 70, and arranged around the receptacle mounting hole 52 on four corners of the main plate 51. Each bolt insertion hole 53 is a through hole penetrating from the one plate surface to the other plate surface of the main plate 51.

As shown in FIG. 4, the fixing plate 50 has a part around the receptacle mounting hole 52 arranged in the plate holding groove 27 and is fixed to the housing 20 with an outer peripheral edge part exposed. The fixing plate 50 is arranged perpendicularly to the tube axis direction in the receptacle 21 (parallel to the facing surface 24 and the case wall 71).

As shown in FIGS. 1 and 4, the reinforcing wall 54 stands up at an angle to the main plate 51 from one of the two long sides of the fixing plate 50. The reinforcing wall 54 is arranged over the entire length of the long side. The reinforcing wall 54 ensures that the main plate 51 does not deflect and hence ensures close contact between the seal 40 and the case wall 71 when the shield connector 10 is mounted on the device case 70.

(Spring Member 60)

The spring 60 is a plate spring made of metal and having both ends supported on the housing 20. The spring 60 includes a resilient deformation portion 61 and first and second supports 63, 64.

As shown in FIGS. 1 and 4, the resilient deformation portion 61 is a plate-like part curved in a substantially U shape. As shown in FIG. 4, the two supports 63, 64 are plate-like parts respectively extending out (in directions away from each other) from both ends of the resilient deformation portion 61.

As shown in FIGS. 1 and 4, the resilient deformation portion 61 is arranged such that a surface facing the facing surface 24 is convex, i.e. a surface facing the device case 70 is convex. A contact 62 is a convex tip part. The contact 60 and its proximate part project outwardly of the receptacle 21, while parts proximate to the supports 63, 64 are located inside the receptacle 21. The contact 62 is to be held in contact with the device-side terminal 73 when the shield connector 10 is mounted on the device case 70.

The first support 63 is fixed inside the spring holding groove 33, as shown in FIG. 4. The second support 64 is arranged to penetrate through the spring holding hole 31, as shown in FIG. 4. A tip part of the second support 64 projects into the wire holding portion 28 and is connected to the wire-side terminal 82.

As shown in FIGS. 1 and 2, the resilient deformation portion 61 includes a plurality of slits 65. Each slit 65 extends in a direction from the first support 63 to the second support 64 and is arranged across the contact 62. One of both end parts of each slit 65 is located at a position slightly closer to the contact 62 than a boundary position between the resilient deformation portion 61 and the first support 63, and the other end part is located at a position slightly closer to the contact 62 than a boundary position between the resilient deformation portion 61 and the second support 64. The slits 65 are parallel to each other and are arranged at a fixed interval. The contact 62 of the resilient deformation portion 61 is divided into a plurality of sections by these slits 65.

Each resilient deformation portion 61 can be deflected to be squeezed in directions toward the supports 63, 64 from the contact 62, i.e. in directions intersecting a plate surface of the fixing plate 50.

[Mounting of Shield Connector 10 on Device Case 70]

Next, the procedure of mounting the shield connector 10 on the device case 70 is described. First, the shield connector 10 is mounted on the case wall 71 in such a posture that the fixing plate 50 is parallel to the case wall 71 and the facing surface 24 is facing toward the case wall 71. At this time, the seal 40 is overlapped with a peripheral edge part of the mounting hole 72 on an outer wall surface of the case wall 71. The contact portion 62 and its peripheral edge part of the spring 60 are inserted into the device case 70 through the mounting hole 72 and held in contact with the device-side terminal 73 (see FIG. 4).

In this state, the fixing plate 50 is fixed to the device case 70 using the bolts B inserted through the bolt insertion holes 53. The bolt B has a general shape including a shaft with an external thread formed on the outer peripheral surface and a head arranged on one end of the shaft and having a larger outer diameter than the shaft, and is screwed into a nut or a screw hole arranged in the device case 70 although not shown in detail. The bolts B are inserted into the bolt insertion holes 53 (see FIG. 1) from a surface of the fixing plate 50 opposite to the case wall 71 (surface opposite to the side where the facing surface 24 is arranged), and tightened in a direction perpendicular to the fixing plate 50 and the case wall 71. According to this tightening, the fixing plate 50 is pressed toward the case wall 71 by the heads of the bolts B. Associated with this, the contact portion 62 of each resilient deformation portion 61 is pressed against each device-side terminal 73 and each resilient deformation portion 61 resiliently comes into contact with the device-side terminal 73 while being deflected in directions toward the supports 63, 64 from the contact 62 (see FIG. 4). In this way, each spring 60 and each device-side terminal 73 are connected electrically.

[Summary]

As described above, according to this embodiment, the shield connector 10 includes the housing 20 with the spring accommodating portion 25 open on the facing surface 24, the fixing plate 50 to be fixed to the housing 20 and mounted on the case wall 71 and the springs 60 arranged inside the spring accommodating portion 25. Each spring 60 includes the first and second supports 63, 64 to be supported on the housing 20 and the resilient deformation portion 61 convexly curved toward the facing surface 24 and having a convex tip part serving as the contact 52 to be brought into contact with the device-side terminal 73, and the resilient deformation portion 61 includes the slits 65 extending from a side connected to the one of the first and second supports 63, 64 toward an opposite side across the contact 62.

According to the above configuration, the spring 60 has a spring property and resiliently contacts the device-side terminal 73 while being deflected in the directions toward the first and second supports 63, 64 from the contact 62 by having the contact 62 pressed by the device-side terminal 73. Thus, if the device-side terminal 73 is arranged at such a position that the spring 60 is pressed thereagainst with the shield connector 10 mounted on the device case 70, the spring 60 can be connected to the device-side terminal 73 by the spring property thereof. Particularly, the slits 65 make it possible to reduce the rigidity of the resilient deformation portion 61 and give a sufficient spring property to the spring 60 to ensure connection to the device-side terminal 73.

This eliminates the need for a bolt for connecting the wire-side terminal 82 and the device-side terminal 73 and also a bolt tightening operation. Further, a space for arranging the bolt and a space for performing the bolt tightening operation are also unnecessary. In this way, the shield connector 10 can be miniaturized and a cost reduction due to a reduction in the number of components and a reduction in the number of operation steps is possible.

Further, there are also the following effects brought about by the resilient deformation portion 61 including the slits 65 besides the ensuring of the spring property as described above.

Even if the shield connector 10 is mounted obliquely, each part of the contact 62 divided by the slits 65 is deflected independently. Thus, the resilient deformation portion 61 can be held in contact with the device-side terminal 73 at plural contact points and the connection reliability of the resilient deformation portion 61 and the device-side terminal 73 can be enhanced. Further, even if external matter enters between the contact 62 and the device-side terminal 73, it escapes into the interior of the slit 65. Thus, a connection error between the spring 60 and the device-side terminal 73 can be avoided.

Further, the shield connector 10 includes the bolts B and the fixing plate 50 is fixed while being pressed toward the case wall 71 by these bolts B.

According to the above configuration, the springs 60 are pressed toward and come into contact with the device-side terminals 73 as the fixing plate 50 is pressed toward and fixed to the case wall 71 by the bolts B. That is, since a direction in which the fixing plate 50 is pressed against the device case 70 by the bolts B and a direction in which the springs 60 are pressed toward the device-side terminals 73 are the same when the shield connector 10 is mounted, the springs 60 and the device-side terminals 73 can be brought resiliently into contact and connected by an operation of mounting the shield connector 10 on the device case 70. In this way, the production process can be further simplified and cost can be reduced.

The invention is not limited to the above described and illustrated embodiment. For example, the following embodiments also are included in the scope of the invention.

The spring 60 has the first support 63 arranged at one end of the resilient deformation portion 61 and the second support 64 arranged at the other end and is supported on the housing 20 on both ends in the above embodiment. However, the support may be arranged at either one of the ends of the resilient deformation portion 61 and the spring 60 may be supported on the housing only on one end part.

Although the resilient deformation portion 61 includes the slits 65 in the above embodiment, the resilient deformation portion may include one slit.

LIST OF REFERENCE SIGNS

10 . . . shield connector (connector)
20 . . . connector housing
24 . . . facing surface (opening surface)
25 . . . spring accommodating portion
50 . . . fixing plate
60 . . . spring member
61 . . . resilient deformation portion
62 . . . contact portion (tip part)
63 . . . first supporting portion
64 . . . second supporting portion
65 . . . slit
B . . . bolt (fixing member)
70 . . . device case
71 . . . case wall
73 . . . device-side terminal

The invention claimed is:

1. A connector to be mounted on a device case with a case wall and a device-side terminal provided inside, comprising:

a connector housing having a facing surface and an opening penetrating through the connector housing to define a spring accommodating portion open on the facing surface, the spring accommodating portion having at least first and second walls opposite each other, and at least one first spring holding portion at the first wall and at least one second spring holding portion at the second wall and facing the at least one first spring holding portion;

a fixing plate to be fixed to the connector housing and mounted on the case wall;

a seal to be sandwiched between the opening surface of the connector housing and the case wall; and at least one spring to be arranged inside the spring accommodating portion, the at least one spring including a first support to be mounted in the at least one first spring holding portion and a second support to be mounted in the at east one second spring holding portion, a resilient deformation portion extending between the first and second supports in an extending direction and convexly curved toward the opening surface, the resilient deformation portion having a convex tip serving as a contact to be brought into contact with the device-side terminal, and at least one slit extending in the extending direction from a first position inward of the first support to a second position inward of the second support.

2. The connector of claim 1, further comprising a fixing member for fixing the fixing plate while pressing the fixing plate toward the case wall.

3. The connector of claim 1, wherein the spring accommodating portion has a long and narrow rectangular cross-section with rounded corners, the at least first and second walls of the spring accommodating portion defining long walls of the spring accommodating portion, and the spring accommodating portion further comprising first and second narrow walls extending between facing ends of the long walls.

4. The connector of claim 1, wherein the at least one first spring holding portion comprises a plurality of first spring holding portions, and the at least one second spring holding portion comprises a plurality of second spring holding portions.

5. The connector of claim 4, wherein the at least one spring comprises a plurality of springs arranged to extend between corresponding pairs of the plurality of first spring holding portions and the plurality of second spring holding portions.

6. The connector of claim 1, wherein the at least one slit comprises a plurality of slits parallel to each other and extending in the extending direction.

* * * * *